US008109662B2

(12) United States Patent
Mozaffari-Afshar et al.

(10) Patent No.: US 8,109,662 B2
(45) Date of Patent: Feb. 7, 2012

(54) HEADLIGHT LENS FOR A VEHICLE HEADLIGHT

(75) Inventors: Mohsen Mozaffari-Afshar, Gera (DE); Bernhard Breeger, Kleineutersdorf (DE)

(73) Assignee: Docter Optics GmbH, Neustadt an der Orla (DE)

( * ) Notice: Subject to any disclaimer, the term of this patent is extended or adjusted under 35 U.S.C. 154(b) by 468 days.

(21) Appl. No.: 11/990,893

(22) PCT Filed: Aug. 4, 2006

(86) PCT No.: PCT/EP2006/007714

§ 371 (c)(1),
(2), (4) Date: Mar. 5, 2009

(87) PCT Pub. No.: WO2007/022861

PCT Pub. Date: Mar. 1, 2007

(65) Prior Publication Data

US 2009/0213608 A1 Aug. 27, 2009

(30) Foreign Application Priority Data

Aug. 22, 2005 (DE) ..... 10 2005 039 808

(51) Int. Cl.
*F21V 5/08* (2006.01)

(52) U.S. Cl. ..... 362/522; 362/507

(58) Field of Classification Search ..... 362/522, 362/475, 507, 538

See application file for complete search history.

(56) References Cited

U.S. PATENT DOCUMENTS

| | | | | |
|---|---|---|---|---|
| 1,235,752 | A * | 8/1917 | Ames, Jr. | 362/538 |
| 1,324,625 | A * | 12/1919 | Shaw | 362/507 |
| 1,433,292 | A * | 10/1922 | Billman et al. | 362/522 |
| 2002/0012250 | A1 | 1/2002 | Nestell et al. | |

FOREIGN PATENT DOCUMENTS

| | | | |
|---|---|---|---|
| DE | 20 2005 004080 | | 7/2005 |
| DE | 20 2005 004 080 | | 7/2007 |
| EP | 0 320 887 | | 8/1993 |
| EP | 1 085 254 | | 3/2001 |
| EP | 1 179 706 | | 5/2003 |
| EP | 1179706 | B1 * | 5/2003 |
| FR | 2 549 934 | | 2/1985 |
| JP | 1-159904 | | 6/1989 |
| JP | 8-321205 | | 12/1996 |
| JP | 2002-050213 | | 2/2002 |

OTHER PUBLICATIONS

International Preliminary Report on Patentability dated Dec. 5, 2007, Int'l Appln. No. PCT/EP2006/007714 filed Aug. 4, 2006.

* cited by examiner

*Primary Examiner* — David V Bruce
(74) *Attorney, Agent, or Firm* — Kenyon & Kenyon LLP

(57) ABSTRACT

The invention relates to a single-piece headlamp lens (2) for a vehicle headlamp (1), in particular for a motor vehicle headlamp (1), wherein the headlamp lens (2) comprises a first region (40) designed as a free-form lens part or as part of an aspherical lens, and at least one second region (41) designed as part of a Fresnel lens.

24 Claims, 5 Drawing Sheets

HEADLIGHT LENS FOR A VEHICLE HEADLIGHT

FIELD OF THE INVENTION

The invention relates to a headlight lens for a vehicle headlight, in particular for a motor vehicle headlight.

BACKGROUND INFORMATION

A headlight lens of this type is known e.g. from DE 10 2004 053 303 A1, DE 299 12 504 U1, DE 36 02 262 C2, DE 44 44 314 A1, FR 2 770 617 A1 and DE 34 30 179 C2. Headlight lenses for a motor vehicle headlight are additionally known from WO 03/074251 A1 and DE 100 52 653 A1.

DE 100 48 494 A1 discloses a headlight comprising an elongated light source, a light channel for the light source with an entrance surface and an exit surface, the light channel being formed by a plurality of light-transmissive laminae lying one above another at least in one direction, and the elongated light source forming an imaging on the entrance surface of the light channel, and also comprising a light-refracting element for projecting a light bundle, the exit surface of the light channel forwarding main and secondary light, the light-refracting element comprising a base part, on which substantially the main light impinges, while the secondary light substantially impinges on a second part of the light-refracting element, and the second part of the light-refracting element having different optical properties from the base part.

It is an object of the invention to reduce the weight of a headlight lens for a vehicle headlight, the intention being to ensure the desired optical properties. In this case the intention, in particular, is to comply with a permissible interval G* of a dimension—also referred to as gradient—for the transition (bright-dark boundary) from a region that can be illuminated by means of the vehicle headlight to a region that cannot be illuminated by means of the vehicle headlight, and a permissible interval HV* of a (so-called) HV value (also called dazzle value).

SUMMARY

The aforementioned object is achieved by means of an, in particular integral, headlight lens for a vehicle headlight, in particular for a motor vehicle headlight, the headlight lens comprising a first region configured as freeform lens part or as part of an aspherical lens and at least one second region configured as part of a Fresnel lens. "Integral" and "integrally configured" shall mean "formed as one piece".

Fresnel lenses are disclosed e.g. on the Internet pages
www.bet.de/lexikon/begriffe/Fresnellinse.htm
www.markenprofi.de/was-lexikon/feld-0/nr-602
www.matheboard.de/lexikon/Fresnellinse,definition.htm
lexikon.freenet.de/Fresnellinse
www.deutscheleuchtfeuer.de/begriffe/fresnellinse.html
www.fotografie-boerse.de/fotolexikon/artikel/Fresnellinse.

According to the Internet page lexikon.freenet.de/Fresnellinse, a Fresnel lens, or more precisely a Fresnel stepped lens, is an optical lens that was invented by Augustin Jean Fresnel. Originally developed for lighthouses, the structural principle enables the construction of large lenses having a short focal length without the weight and volume of conventional lenses. In the Fresnel lens the volume is reduced by division into ring-shaped regions. The thickness is reduced in each of said regions, such that the lens acquires a series of ring-shaped steps. Fresnel lenses would be used where the lens weight is critical and the imaging quality is of secondary importance. Examples are illumination beam paths in ship's lanterns or lighthouses. The ground-glass screens of reflex cameras are also embodied as Fresnel lenses. Moreover, these lenses are used in special spotlights for event and theatre technology. Inexpensive Fresnel lenses could be pressed from plastic and would find application in daylight projectors, in simple hand-held magnifying glasses and as wide angle lenses in automobile rear windows.

According to the Internet page www.deutscheleuchtfeuer.de/begriffe/fresnellinse.html, the lens developed by the Frenchman J. A. Fresnel comprises a central, thin spherical or aspherical lens, surrounded by prism-type ring zones which are arranged in stepped fashion and which all have the same focal point and approximately the same thickness as the central lens.

A part of a Fresnel lens is intended within the meaning of the invention to be in particular a part of a central aspherical lens partly surrounded by, in particular at least two, segments of prism-type ring zone parts which are arranged in stepped fashion and which, in a configuration of the invention, all have the same focal point and which, in a configuration of the invention, have approximately the same thickness as the central aspherical lens.

An aspherical lens within the meaning of the invention is in particular a lens having at least one convex surface. A part of an aspherical lens is intended within the meaning of the invention to comprise in particular not a complete aspherical lens. A part of an aspherical lens is intended within the meaning of the invention to comprise in particular not more than approximately two thirds, in particular not more than approximately half, of an aspherical lens.

In a configuration of the invention, the first region comprises a surface that is to be facing away from a light source and that runs substantially continuously.

In a further configuration of the invention, the first region comprises a surface that is to be facing away from a light source with a convex profile.

The aforementioned object is additionally achieved by means of an, in particular integral, headlight lens for a vehicle headlight comprising a light source, in particular for a motor vehicle headlight, the headlight lens comprising an, in particular integral, lens body composed of a transparent material, in particular glass, which comprises a surface that is to face the light source and a surface that is to be facing away from the light source, the headlight lens comprising a first region and at least one second region, the surface that is to be facing away from the light source running substantially continuously in the first region, and the surface that is to be facing away from the light source comprising in the second region at least two segments separated from one another by a step.

A continuous profile of a surface is intended within the meaning of the invention in particular to mean that the surface (in its optically active region) has no step or no discontinuity that significantly influences light passing through the headlight lens. A step within the meaning of the invention is in particular a shoulder between two segments which comprises at least 2 mm, in particular 3 mm, in the direction of an optical axis of the headlight lens.

A segment within the meaning of the invention has in particular a surface that is to be facing away from the light source with a continuous profile.

In a further configuration of the invention, the surface that is to be facing away from the light source comprises in the second region three segments separated from one another by steps.

In a further configuration of the invention, the surface that is to be facing away from the light source comprises in the second region at most five segments separated from one another by steps.

In a further configuration of the invention, the steps are configured substantially in ring-segment-shaped fashion.

In a further configuration of the invention, the segments are configured substantially in ring-segment-shaped fashion or in circle- or ellipse-segment-shaped fashion.

In this case, a ring-segment-shaped configuration within the meaning of the invention means in particular that a perpendicular projection of a step or of a segment onto a plane orthogonal to the optical axis is configured in ring-segment-shaped fashion. In this case, a circle- or ellipse-segment-shaped configuration within the meaning of the invention means in particular that a perpendicular projection of a segment onto a plane orthogonal to the optical axis is configured in circle- or ellipse-segment-shaped fashion.

In a further configuration of the invention, at least two segments, in particular at least three segments, have substantially the same focal point. In a further configuration of the invention, all of the segments have substantially the same focal point. In a further configuration of the invention, at least two segments, in particular at least three segments, have substantially the same focal point as the first region. In a further configuration of the invention, all of the segments have substantially the same focal point as the first region.

It can be provided that a focal point within the meaning of the invention can also be a small area.

In a further configuration of the invention, the surface that is to face the light source is substantially plane.

In a further configuration of the invention, the surface that is to be facing away from the light source is configured in the second region as a surface (the surface that is to be facing away from a light source) of a Fresnel lens. In a further configuration of the invention, the second region of the headlight lens is configured as part of a Fresnel lens.

In a further configuration of the invention, the surface that is to be facing away from the light source is convex in the first region.

In a further configuration of the invention, the first region comprises approximately between one and two thirds of the headlight lens. In a further configuration of the invention, the second region comprises approximately between two and one third of the headlight lens. In a further configuration of the invention, the first region and the second region each comprise approximately half of the headlight lens. If a region comprises a part of a headlight lens, such as, for instance, one third, half or two thirds of the headlight lens, then this is intended within the meaning of the invention in particular to mean that a perpendicular projection of said region onto a plane orthogonal to the optical axis comprises said part, such as, for instance, one third, half or two thirds, of a projection of the headlight lens onto the plane orthogonal to the optical axis.

In a further configuration of the invention, a separation between the first region and the second region runs approximately through an optical axis of the headlight lens.

In a further configuration of the invention, a transition area between the first region and the second region is inclined approximately between 1° and 20°, in particular between 5° and 15°, relative to an optical axis of the headlight lens. It can be provided that the transition area is curved (cylindrical, spherical, aspherical or freeform).

In a further configuration of the invention, the headlight lens is blank-pressed, in particular on both sides.

In a further configuration of the invention, the headlight lens is composed (substantially) of glass.

In a configuration it can be provided that the surface that is to face the light source and/or the surface that is to be facing away from the light source have substantially or almost a roughness of less than 0.05 μm, in particular in the case of a light transmission at the surface of at least 90%. Roughness within the meaning of the invention is intended to be defined in particular as $R_a$, in particular according to ISO 4287.

The aforementioned object is additionally achieved by means of a vehicle headlight comprising a headlight lens comprising one or more of the aforementioned features. In this case it is provided, in particular, that the headlight lens comprises a first region configured as freeform lens part or as part of an aspherical lens and at least one second region configured as part of a Fresnel lens, or that the vehicle headlight comprises a light source and the headlight lens comprises a lens body composed of a transparent material, which comprises a surface facing the light source and a surface facing away from the light source, the headlight lens comprising a first region and at least one second region, the surface facing away from the light source running substantially continuously in the first region, and the surface facing away from the light source comprising in the second region at least two segments separated from one another by a step.

In a configuration of the invention, the first region is arranged above the second region.

In a further configuration of the invention, the vehicle headlight comprises a mask, an edge of the mask being able to be imaged as a bright-dark boundary by means of the headlight lens.

The aforementioned object is additionally achieved by means of a motor vehicle comprising a headlight lens comprising one or more of the aforementioned features or comprising a vehicle headlight comprising one or more of the aforementioned features. In a configuration of the invention, in this case the bright-dark boundary can be imaged onto a roadway on which the motor vehicle can be arranged.

The aforementioned object is additionally achieved by means of an, in particular integral, headlight lens which is also in particular blank-pressed, in particular on both sides, for a vehicle headlight, in particular for a motor vehicle headlight, the headlight lens comprising a first region configured as part of a spherical or aspherical lens and at least one second region configured as part of a Fresnel lens, and the first region comprising approximately between one and two thirds of the headlight lens.

The aforementioned object is additionally achieved by means of an, in particular integral, headlight lens which is also in particular blank-pressed, in particular on both sides, for a vehicle headlight comprising a light source, in particular for a motor vehicle headlight, the headlight lens comprising an, in particular integral, lens body composed of a transparent material, in particular glass, which comprises a surface that is to face the light source and a surface that is to be facing away from the light source, the headlight lens comprising a first region and at least one second region, the surface that is to be facing away from the light source running substantially continuously in the first region, the surface that is to be facing away from the light source comprising in the second region at least two segments separated from one another by a step, and the first region comprising approximately between one and two thirds of the headlight lens.

The aforementioned object is additionally achieved by means of an, in particular integral, headlight lens which is also in particular blank-pressed, in particular on both sides, for a vehicle headlight, in particular for a motor vehicle headlight, the headlight lens comprising a first region configured as freeform lens part or as part of an aspherical lens and at least one second region configured as part of a Fresnel lens, and a transition area between the first region and the second region being inclined approximately between 1° and 20°, in particular between 5° and 15°, relative to an optical axis of the headlight lens. It can be provided that the transition area is curved (cylindrical, spherical, aspherical or freeform).

The aforementioned object is additionally achieved by means of an, in particular integral, headlight lens which is also in particular blank-pressed, in particular on both sides, for a vehicle headlight comprising a light source, in particular for a motor vehicle headlight, the headlight lens comprising an, in particular integral, lens body composed of a transparent material, in particular glass, which comprises a surface that is to face the light source and a surface that is to be facing away from the light source, the headlight lens comprising a first region and at least one second region, the surface that is to be facing away from the light source running substantially continuously in the first region, the surface that is to be facing away from the light source comprising in the second region at least two segments separated from one another by a step, and a transition area between the first region and the second region being inclined approximately between 1° and 20°, in particular between 5° and 15°, relative to an optical axis of the headlight lens. It can be provided that the transition area is curved (cylindrical, spherical, aspherical or freeform).

The aforementioned object is additionally achieved by means of a vehicle headlight, in particular for a motor vehicle, the vehicle headlight comprising an, in particular integral, headlight lens and a mask, and an edge of the mask being able to be imaged as a bright-dark boundary by means of the headlight lens, and the headlight lens comprising a first region configured as freeform lens part or as part of an aspherical lens and at least one second region configured as part of a Fresnel lens.

The aforementioned object is additionally achieved by means of a vehicle headlight, in particular for a motor vehicle, the vehicle headlight comprising a light source, an, in particular integral, headlight lens and a mask, and an edge of the mask being able to be imaged as a bright-dark boundary by means of the headlight lens, the headlight lens comprising an, in particular integral, lens body composed of a transparent material, in particular glass, which comprises a surface that is to face the light source and a surface that is to be facing away from the light source, the headlight lens comprising a first region and at least one second region, the surface that is to be facing away from the light source running substantially continuously in the first region, and the surface that is to be facing away from the light source comprising in the second region at least two segments separated from one another by a step.

Motor vehicle within the meaning of the invention is in particular a land vehicle which can be used individually in traffic. Motor vehicles within the meaning of the invention are in particular not restricted to land vehicles with an internal combustion engine.

A first and/or second region should be understood within the meaning of the invention in particular such that a perpendicular projection of the first and/or of the second region onto a plane orthogonal to the optical axis forms a segment of a circle or of an ellipse. A first and a second region should be understood within the meaning of the invention in particular such that a perpendicular projection of the first region onto a plane orthogonal to the optical axis forms a first segment of a circle or of an ellipse and that a perpendicular projection of the second region onto a plane orthogonal to the optical axis forms a second segment of the circle or of the ellipse, the first and second segments of the circle or of the ellipse together forming a complete circle or a complete ellipse, respectively.

Further advantages and details will become apparent from the following description of exemplary embodiments.

DETAILED DESCRIPTION

Figure 1:
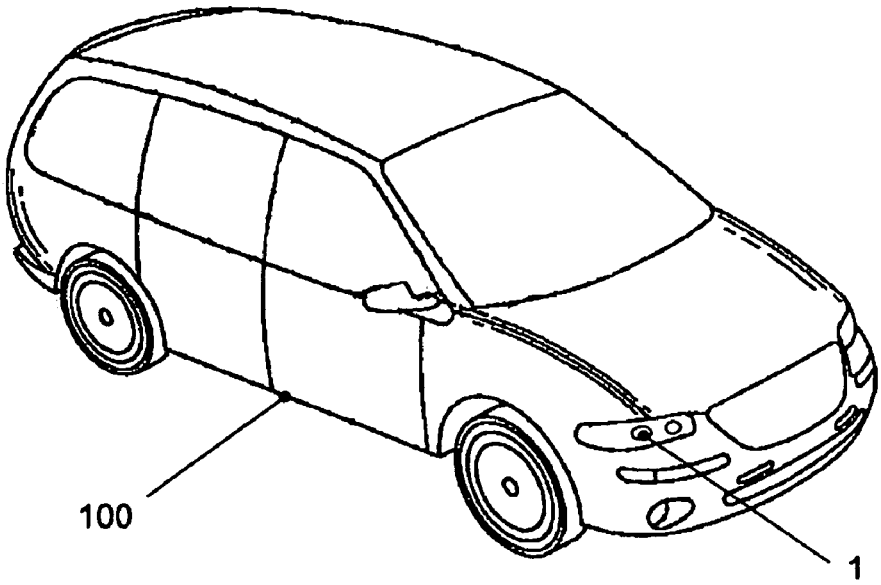
FIG. 1 shows a motor vehicle.
Figure 2:
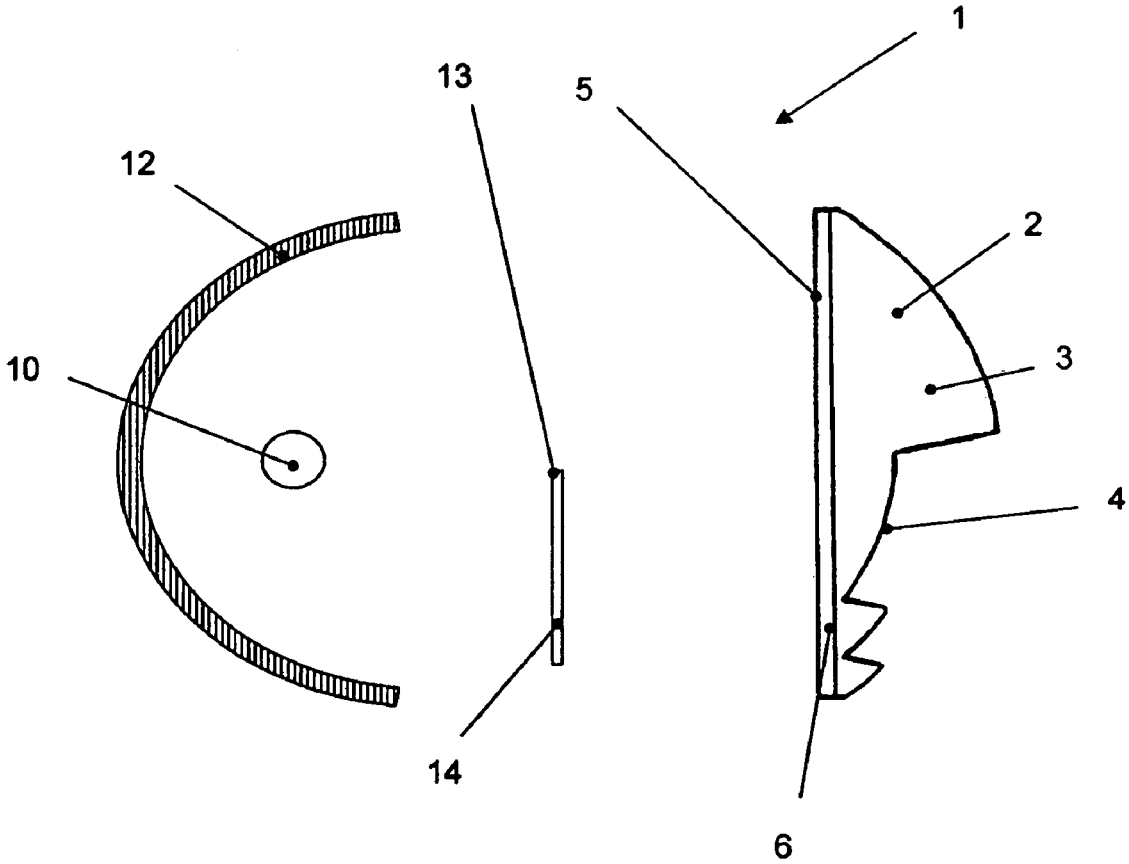
FIG. 2 shows a schematic illustration of a vehicle headlight.

FIG. 1 shows a motor vehicle 100 comprising a vehicle headlight 1—illustrated schematically in FIG. 2—comprising a light source 10 for generating light, a reflector 12 for reflecting light that can be generated by means of the light source 10, and a mask 14. The vehicle headlight 1 additionally comprises an integral headlight lens 2 that is blank-pressed on both sides and serves for altering the beam direction of light that can be generated by means of the light source 10, and in particular for imaging an edge—designated by reference symbol 13 in FIG. 2—of the mask 14 as a bright-dark boundary.

The headlight lens 2 comprises a lens body 3 composed of a transparent material, in particular glass, which comprises a substantially plane surface 5 facing the light source 10 and a surface 4 facing away from the light source 10. The headlight lens 2 additionally optionally comprises an edge 6 by means of which the headlight lens 2 can be fixed in the vehicle headlight 1. The elements in FIG. 2 are depicted taking account of simplicity and clarity and not necessarily as true to scale. Thus, by way of example, the orders of magnitude of some elements are represented in exaggerated fashion relative to other elements, in order to improve the understanding of the exemplary embodiment of the present invention.

Figure 3:
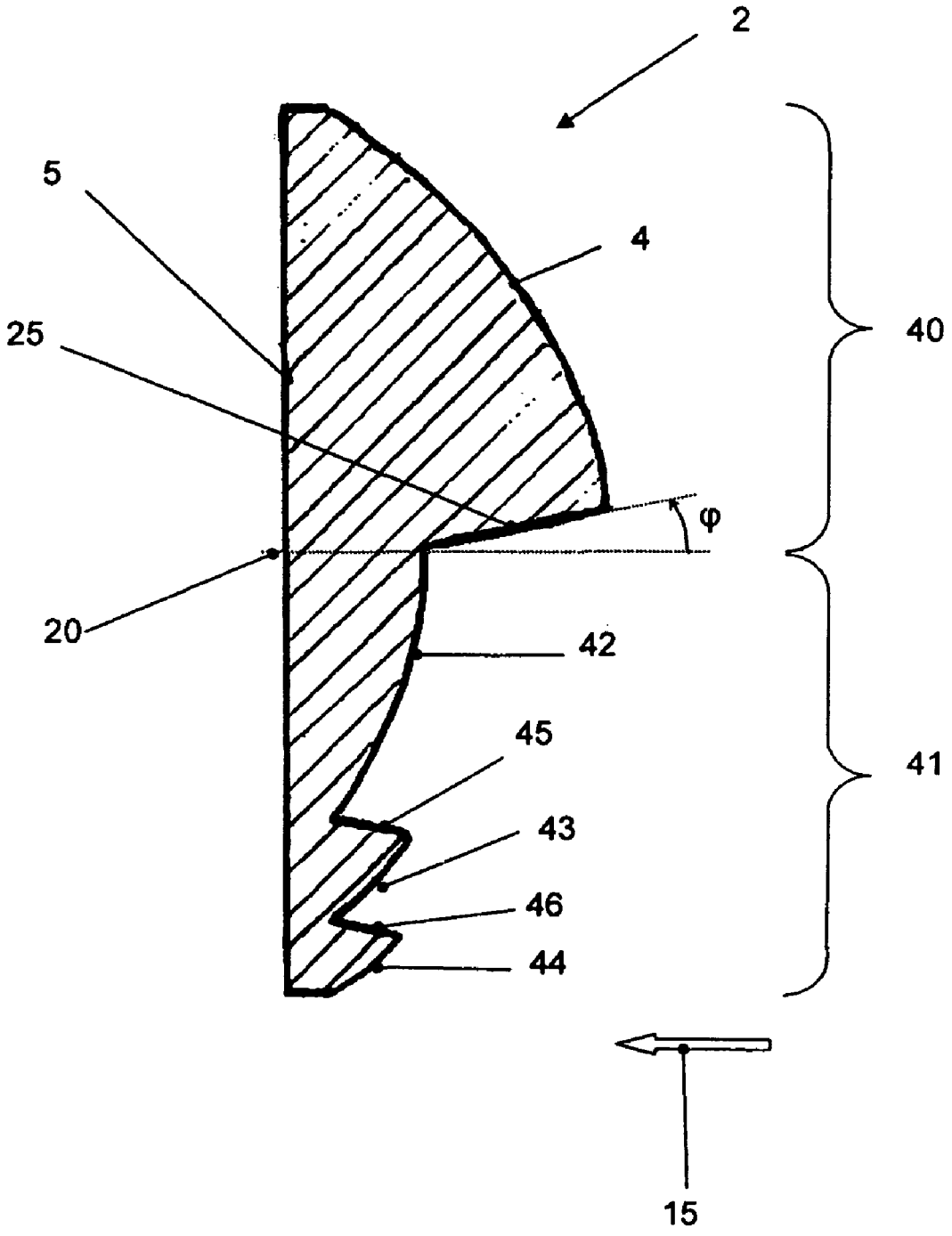
FIG. 3 shows a cross section through an exemplary embodiment of a headlight lens for a vehicle headlight in accordance with FIG. 2.
Figure 4:
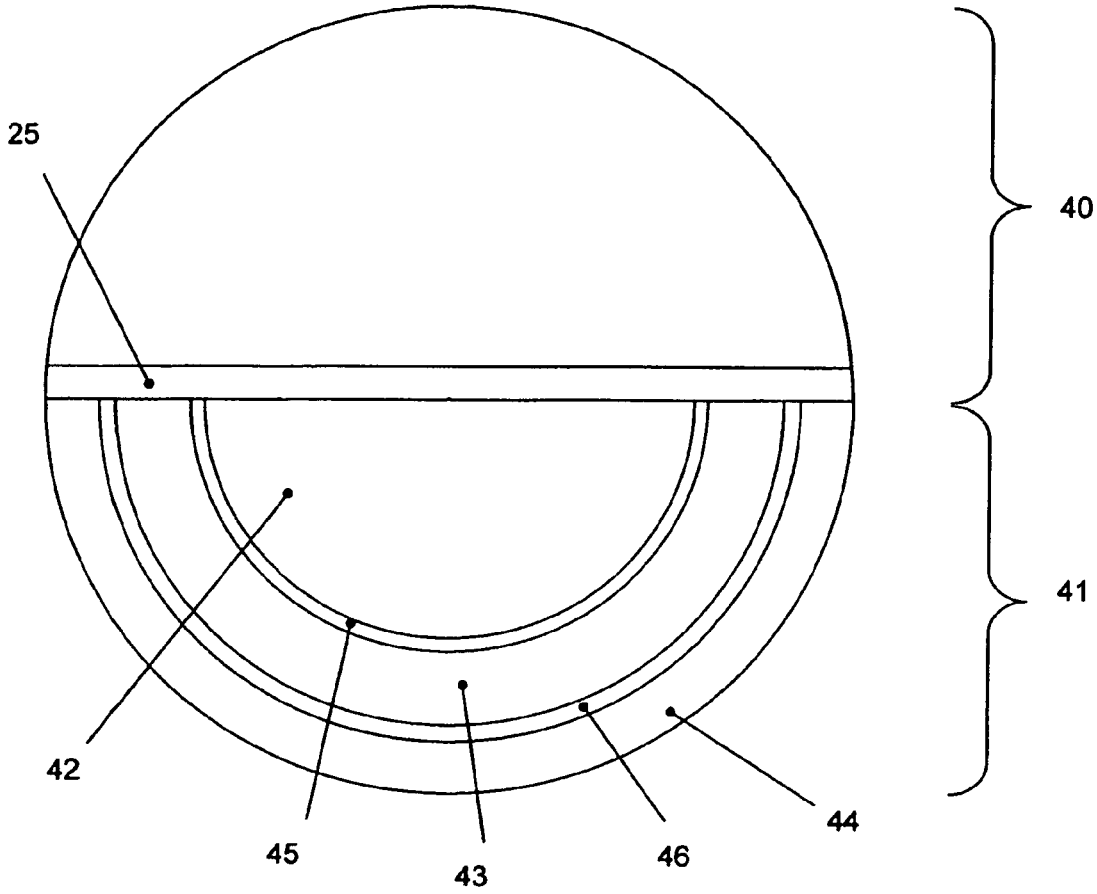
FIG. 4 shows a plan view of a headlight lens in accordance with FIG. 3.

FIG. 3 shows a cross section through an exemplary embodiment of the headlight lens 2 for the vehicle headlight 1 in accordance with FIG. 2. FIG. 4 shows a plan view of the headlight lens 2 in the direction of an arrow designated by reference symbol 15 in FIG. 3.

The headlight lens 2 comprises a first region 40 and at least one second region 41, the surface 4 facing away from the light source 10 running continuously in the first region 40 as part of an aspherical lens, and the surface 4 facing away from the light source 10 being configured in the second region 41 as part of a Fresnel lens and comprising three segments 42, 43 and 44 each separated from one another by a step 45 and 46, respectively. In this case, the segment 42 is part of a (central) aspherical lens. The segments 42 and 43 are configured in ring-segment-shaped fashion and together with the steps 45 and 46, respectively, form prism-shaped ring zone parts. In this case, the segment 43 and the step 45, and the segment 44 and the step 46 respectively form a prism-shaped ring zone part. The focal points of the first region 40 configured as part of an aspherical lens and also of the segments 42, 43 and 44 are substantially identical.

The first region can comprise approximately between one and two thirds of the headlight lens 2 and the second region can comprise approximately between two and one third of the headlight lens 2. In the exemplary embodiment illustrated, both the first region and the second region each comprise half of the headlight lens 2.

A transition area 25 inclined approximately by an angle $\phi$ between 1° and 20°, in particular between 5° and 15°, approximately 11° in the exemplary embodiment illustrated, relative to the optical axis 20 of the headlight lens 2 is provided between the first region and the second region. The transition area 25 is plane in the exemplary embodiment illustrated. However, it can also be provided that the transition area is curved (cylindrical, spherical, aspherical or freeform).

The steps 45 and 46 are inclined between −1° and −20°, in particular between −5° and −15°, relative to the optical axis 20 of the headlight lens 2.

Figure 5:
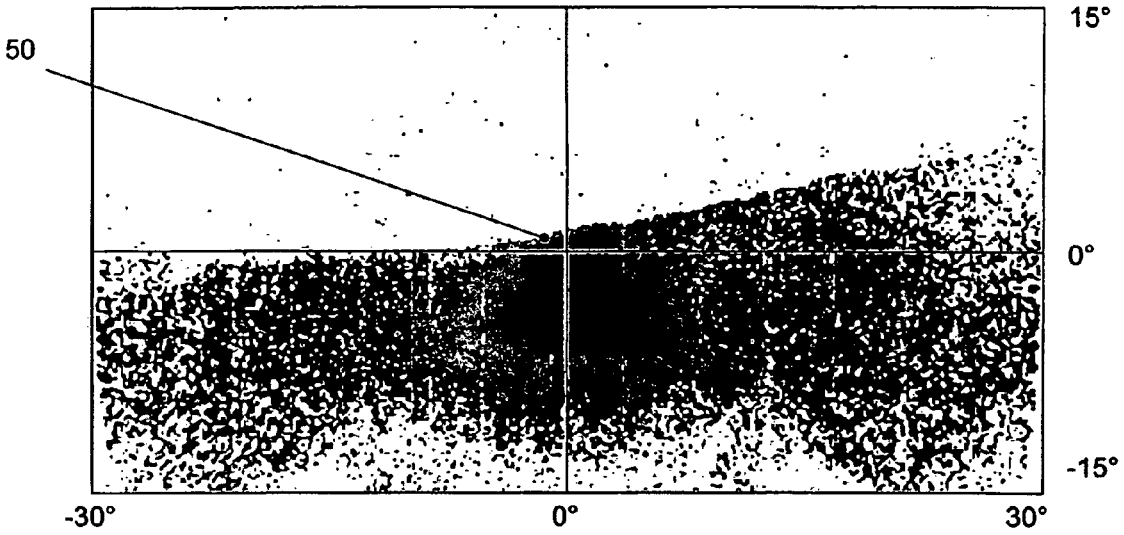
FIG. 5 shows a two-dimensional intensity distribution of light emitted by means of the vehicle headlight in accordance with FIG. 2.
Figure 6:
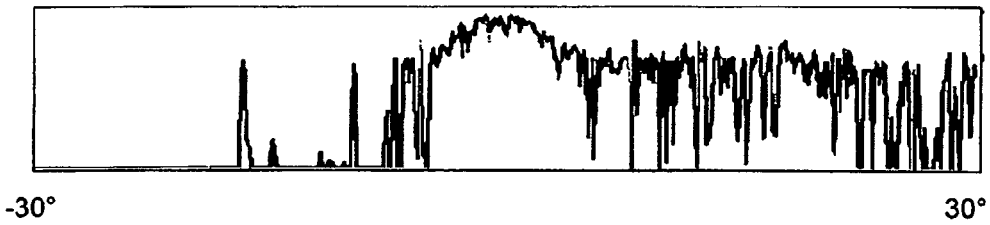
FIG. 6 shows a horizontal intensity distribution of light emitted by means of the vehicle headlight in accordance with FIG. 2.
Figure 7:
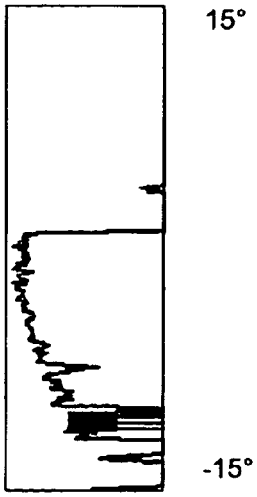
FIG. 7 shows a vertical intensity distribution of light emitted by means of the vehicle headlight in accordance with FIG. 2.

FIG. 5 shows a two-dimensional intensity distribution (in a main luminous region) of light emitted by means of the vehicle headlight in accordance with FIG. 2, plotted against the horizontal angle (abscissa) and the vertical angle (ordinate), regions of very low or no light intensity being represented white, regions of medium light intensity being represented black, and regions of high light intensity being represented grey. Reference symbol 50 designates the bright-dark boundary. FIG. 6 shows the intensity distribution (ordinate) of light emitted by means of the vehicle headlight in accordance with FIG. 2 for a vertical angle of 0°, plotted against the horizontal angle (abscissa). FIG. 7 shows the intensity distribution (abscissa) of light emitted by means of the vehicle headlight in accordance with FIG. 2 for a horizontal angle of 0°, plotted against the vertical angle (ordinate).

Figure 8:
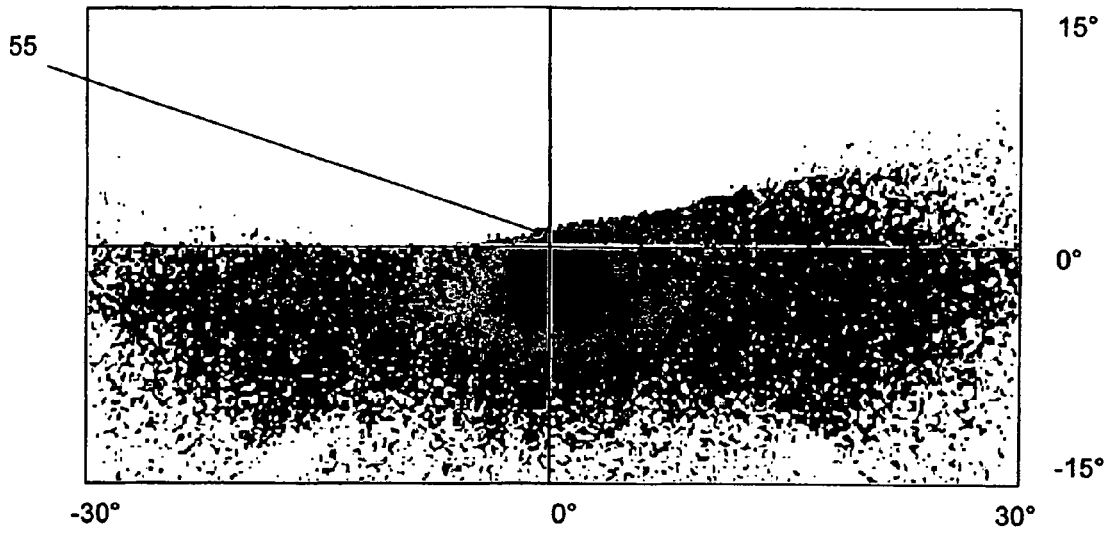
FIG. 8 shows a two-dimensional intensity distribution of light emitted by means of a vehicle headlight with an aspherical headlight lens and FIG. 9 shows a two-dimensional intensity distribution of light emitted by means of the vehicle headlight in accordance with FIG. 2.

FIG. 8 shows a two-dimensional intensity distribution of light emitted by means of a vehicle headlight comprising an aspherical headlight lens—having the same diameter and the same focal length as the headlight lens 2—plotted against the horizontal angle (abscissa) and the vertical angle (ordinate), regions of very low or no light intensity being represented white, regions of medium light intensity being represented black, and regions of high light intensity being represented grey. Reference symbol 55 designates the bright-dark boundary.

The headlight lens 2 is more than 25% lighter than a corresponding aspherical headlight lens whose two-dimensional intensity distribution is shown in FIG. 8. A comparison between the two-dimensional intensity distribution of the headlight lens 2 as illustrated in FIG. 5 and the two-dimensional intensity distribution of the corresponding aspherical headlight lens as illustrated in FIG. 8 shows that, despite the weight reproduction, the optical properties with regard to the gradient and the dazzle value that can be obtained with the headlight lens 2 are virtually identical to those which can be obtained with the corresponding aspherical headlight lens.

Figure 9:
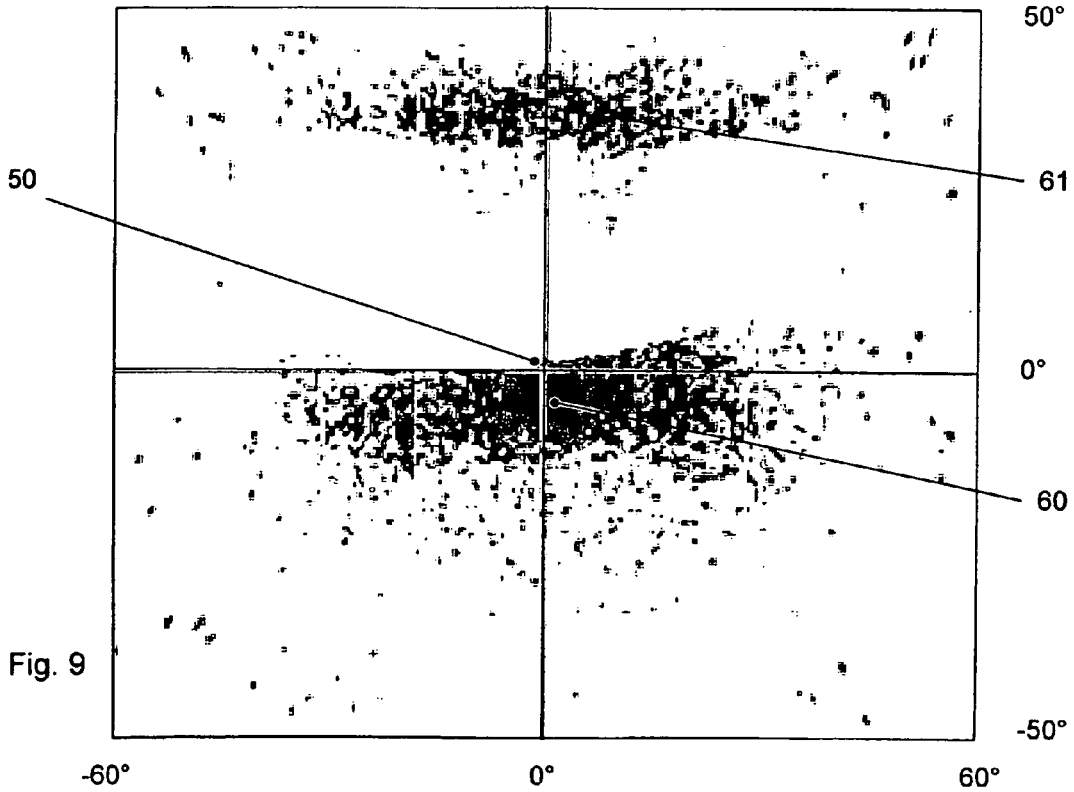

In the exemplary embodiment described, the headlight lens 2 is configured in such a way that the light that can be generated by the light source 10 can be directed by means of the headlight lens 2 into a main luminous region for illuminating a roadway or road and into a secondary luminous region separate from the main luminous region (at least at a distance of 10 m). The main luminous region designated by reference symbol 60 and the secondary luminous region designated by reference symbol 61 are illustrated in FIG. 9, FIG. 9 showing a two-dimensional intensity distribution—illustrated in a larger range in comparison with the two-dimensional intensity distribution in accordance with FIG. 5—of light emitted by means of the vehicle headlight in accordance with FIG. 2, plotted against the horizontal angle (abscissa) and the vertical angle (ordinate). In this case, regions of very low or no light intensity are represented white, regions of medium light intensity are represented black, and regions of high light intensity are represented grey.

In a configuration, at least 80%, in particular at least 85% to 97%, of the light that can emerge or emerges from the surface 4 facing away from the light source 10 is allotted to the main luminous region 60. In a further configuration, less than 20%, in particular less than 15% to 3%, of the light that can emerge or emerges from the surface 4 facing away from the light source 10 is allotted to the secondary luminous region 61. By way of example, traffic signs can be illuminated or lit up by means of the secondary luminous region 61. Main luminous region 60 and secondary luminous region 61 should be regarded as separate if an unilluminated region lies between them. In said unilluminated region, the light intensity is virtually zero or negligibly small.

The intensity distributions illustrated in FIG. 5, FIG. 6, FIG. 7, FIG. 8 and FIG. 9 relate to a distance of approximately 25 m from the vehicle headlight 1.

In one configuration it can be provided that the surface facing the light source and/or the surface facing away from the light source substantially or largely have a roughness of less than 0.05 μm, in particular in the case of light transmission at the surface of at least 90%. However, partial regions can have a larger roughness. Such partial regions having a larger roughness are configured in particular in accordance with DE 10 2004 011 084.

In a further configuration it can be provided that an emblem is embossed in particular on that surface of the transparent shaped part which faces the light source.

Said emblem is advantageously arranged in particular on that surface of the transparent shaped part which faces the first light source. The aforementioned emblem is advantageously configured in accordance with an emblem disclosed in DE 10 2004 011 104.

What is claimed is:

1. A vehicle headlight, the vehicle headlight comprising an integrally configured headlight lens having:

a first region configured as one of the group (a) freeform lens part and (b) part of an aspherical lens; and at least a second region arranged below the first region and configured as part of a Fresnel lens;

wherein the surface facing the light source is substantially planar.

2. The vehicle headlight according to claim 1, wherein the first region comprises between one and two thirds of the headlight lens.

3. The vehicle headlight according to claim 2, wherein the second region comprises approximately between two and one third of the headlight lens.

4. The vehicle headlight according to claim 1, wherein the first region and the second region each comprise essentially half of the headlight lens.

5. The vehicle headlight according to claim 1, the headlight lens further comprising:

a separation between the first region and the second region running essentially through an optical axis of the headlight lens.

6. The vehicle headlight according to claim 1, said headlight lens comprising:

a transition area between the first region and the second region being inclined approximately between 1° and 20° relative to an optical axis of the headlight lens.

7. A vehicle headlight, the vehicle headlight comprising an integrally configured headlight lens having an integral lens body composed of glass, the integral lens body comprising:

a first region;

at least a second region arranged below the first region;

a surface facing the light source; and a surface facing away from the light source, the surface facing away from the light source running substantially continuously in the first region, and the surface facing away from the light source comprising in the second region at least three segments separated from one another by a step.

8. The vehicle headlight according to claim 7, wherein the surface facing away from the light source comprises in the second region at most five segments separated from one another by steps.

9. The vehicle headlight a according to claim 7, wherein the steps are configured substantially in ring-segment-shaped fashion.

10. The vehicle headlight according to claim 7, wherein the first region and the second region each comprise essentially half of the headlight lens.

11. The vehicle headlight according to claim 7, the headlight lens further comprising:

a separation between the first region and the second region running essentially through an optical axis of the headlight lens.

12. A vehicle headlight lens comprising:

a first region configured as one of the group (a) freeform lens part and (b) part of an aspherical lens;

at least a second region configured as part of a Fresnel lens; and a transition area between the first region and the second region being inclined approximately between 1° and 20° relative to an optical axis of the headlight lens.

13. The vehicle headlight lens according to claim 12, wherein the surface facing the light source is substantially planar.

14. The vehicle headlight lens according to claim 12, wherein the first region comprises between one and two thirds of the headlight lens.

15. The vehicle headlight lens according to claim 14, wherein the second region comprises approximately between two and one third of the headlight lens.

16. The vehicle headlight lens according to claim 12, wherein the first region and the second region each comprise essentially half of the headlight lens.

17. A vehicle headlight lens having an integral lens body composed of glass, the integral lens body comprising:

a first region;

at least a second region;

a surface facing the light source;

a surface facing away from the light source, the surface facing away from the light source running substantially continuously in the first region, and the surface facing away from the light source comprising in the second region at least two segments separated from one another by a step; and a transition area between the first region and the second region being inclined approximately between 1° and 20° relative to an optical axis of the headlight lens.

18. The vehicle headlight lens according to claim 17, wherein the surface facing away from the light source comprises in the second region at most five segments separated from one another by steps.

19. The vehicle headlight lens according to claim 17, wherein the steps are configured substantially in ring-segment-shaped fashion.

20. The vehicle headlight lens according to claim 17, wherein the first region and the second region each comprise essentially half of the headlight lens.

21. An integrally configured vehicle headlight lens comprising:

a first region configured as one of the group (a) freeform lens part and (b) part of an aspherical lens;

at least a second region confiqured as part of a Fresnel lens;

a separation between the first region and the second region running essentially through an optical axis of the headlight lens; and a transition area between the first region and the second region being inclined approximately between 1° and 20° relative to an optical axis of the headlight lens.

22. An integrally configured vehicle headlight lens comprising:

a first region configured as one of the group (a) freeform lens part and (b) part of an aspherical lens;

at least a second region configured as part of a Fresnel lens, the second region having substantially the same focal roint as the first region; and a transition area between the first region and the second region being inclined approximately between 1° and 20° relative to an optical axis of the headlight lens.

23. The vehicle headlight lens according to claim 22, said headlight lens further comprising:

a separation between the first region and the second region running essentially through an optical axis of the headlight lens.

24. A vehicle headlight, the vehicle headlight comprising an integrally configured headlight lens having:

a first region configured as one of the group (a) freeform lens part and (b) part of an aspherical lens;

at least a second region arranged below the first region and configured as part of a Fresnel lens; and a transition area between the first region and the second region being inclined approximately between 1° and 20° relative to an optical axis of the headlight lens.

* * * * *